US008166678B2

(12) United States Patent
Martinez et al.

(10) Patent No.: US 8,166,678 B2
(45) Date of Patent: May 1, 2012

(54) TOOTH AND ADAPTOR FOR DREDGING MACHINE

(75) Inventors: Angel Martinez, Barcelona (ES); Francisco Perez, Barcelona (ES); Joan Tuto, Girona (ES); Ester Alonso, Girona (ES)

(73) Assignee: Metalogenia, S.A., Barcelona (ES)

( * ) Notice: Subject to any disclaimer, the term of this patent is extended or adjusted under 35 U.S.C. 154(b) by 322 days.

(21) Appl. No.: 12/439,068

(22) PCT Filed: Sep. 1, 2006

(86) PCT No.: PCT/ES2006/000498

§ 371 (c)(1),
(2), (4) Date: Apr. 27, 2009

(87) PCT Pub. No.: WO2008/025859

PCT Pub. Date: Mar. 6, 2008

(65) Prior Publication Data

US 2009/0320333 A1 Dec. 31, 2009

(51) Int. Cl.
*E02F 9/28* (2006.01)

(52) U.S. Cl. ..... 37/452

(58) Field of Classification Search ..... 37/446–460, 37/466; 299/103–105, 55, 82.1, 83.1, 101; 172/540, 554, 555

See application file for complete search history.

(56) References Cited

U.S. PATENT DOCUMENTS

| | | | | |
|---|---|---|---|---|
| 2,040,085 | A | 5/1936 | Fykse et al. | |
| 2,230,424 | A | 2/1941 | Bruton | |
| 2,385,395 | A | 9/1945 | Baer | |
| 2,919,506 | A * | 1/1960 | Larsen | 37/457 |
| 3,624,827 | A * | 11/1971 | Liess et al. | 37/92 |
| 3,791,054 | A | 2/1974 | Bierwith | |
| 3,919,792 | A * | 11/1975 | Hahn et al. | 37/455 |
| 4,261,620 | A * | 4/1981 | Troxler | 299/113 |
| 4,275,929 | A * | 6/1981 | Krekeler | 299/102 |
| 4,360,981 | A * | 11/1982 | Bierwith et al. | 37/450 |
| 4,625,439 | A | 12/1986 | Johansson et al. | |
| 4,642,920 | A * | 2/1987 | Lehnhoff | 37/452 |
| 4,751,785 | A * | 6/1988 | Johansson et al. | 37/459 |
| 5,188,680 | A * | 2/1993 | Hahn et al. | 148/593 |
| 5,778,570 | A | 7/1998 | Eichelberger | |
| 5,782,019 | A * | 7/1998 | Launder et al. | 37/446 |
| 6,836,983 | B2 * | 1/2005 | Pallas Moreno et al. | 37/452 |
| 6,865,828 | B1 * | 3/2005 | Molino et al. | 37/454 |
| 7,690,136 | B2 * | 4/2010 | Breken | 37/452 |
| 7,694,443 | B2 * | 4/2010 | Gabela et al. | 37/455 |
| 2007/0227051 | A1 * | 10/2007 | Carpenter et al. | 37/452 |
| 2008/0028644 | A1 * | 2/2008 | Lopez Almendros et al. | 37/457 |
| 2009/0320333 | A1 * | 12/2009 | Martinez et al. | 37/450 |

FOREIGN PATENT DOCUMENTS

| | | | |
|---|---|---|---|
| ES | 291.753(1 | Y | 2/1987 |
| WO | WO 2005005737 | A1 * | 1/2005 |

* cited by examiner

*Primary Examiner* — Robert Pezzuto
(74) *Attorney, Agent, or Firm* — Sughrue Mion, PLLC

(57) ABSTRACT

The tooth and adaptor for dredging machines object of the present invention relates to a tooth or wear member which, attached to an adaptor or adaptor member, creates an assembly the purpose of which is to deepen and clean the beds of ports, rivers, channels, etc., removing therefrom sludge, stones, sand, etc., the adaptors being attached to the blades of the propellers and thus forming the cutter head of the dredging machine. The constructive features of the coupling between the tooth and the tooth bar or adaptor allow making better use of the cutting material of the tooth and a simple and quick replacement thereof in the adaptor, between other advantages.

26 Claims, 10 Drawing Sheets

H1+H2= H3

TOOTH AND ADAPTOR FOR DREDGING MACHINE

OBJECT OF THE INVENTION

The present invention, tooth and adaptor for dredging machines, relates to a tooth or wear member which, attached to an adaptor or adaptor member, creates an assembly the purpose of which is to deepen and clean the beds of ports, rivers, channels, etc., removing therefrom sludge, stones, sand, etc., the adaptors being attached to the blades of the propellers and thus forming the cutter head of the dredging machine.

The dredging machine, or dredger, allows excavating, transporting and depositing material that is located under the water, and they can be mechanical or hydraulic machines, the mechanical machines being used with cutting members, teeth or blades for their use on compact terrain.

The tooth and adaptor object of the present invention are preferably intended to be used in dredging machines having a suctioning cutter head of the type which while at the same time it excavates the terrain under the water, the loosened material is suctioned by a pump and transported through a pipe to somewhere else.

STATE OF THE ART

Systems of tooth and adaptor or adaptors are known in the state of the art for their application in dredging operations. The main objective of said operations is to remove material from marine or river beds, and to do this it is common to use dredge boats including a dredge or dredging machine on which the various teeth are arranged and in turn connected to tooth bars or adaptors.

The U.S. Pat. No. 3,349,548-B describes a tooth and adaptor system attached to one another by means of an elastic strap such that if such strap is poorly arranged, the entire system is altered as to its correct assembly. It also only has one contact area between the tooth and the adaptor, which negatively affects the distribution of stresses.

Another, also US, U.S. Pat. No. 4,642,920-B describes a tooth and adaptor system attached to one another by means of a retaining system formed by a pin, the area where the pin is housed being easily accessed by dirt, making the subsequent removal thereof difficult. This system presents difficulty in absorbing the torsional and bending stresses and loads, generating a strong lever reaction in the system. As with the preceding patent document, there are few contact surfaces between the tooth and the adaptor.

Spanish patent document number ES-2077412-A describes a tooth and adaptor assembly made up of three parts requiring the use of two fastening systems. The fact that it has three parts complicates the entire system because it requires a larger number of spare parts and three fastening systems, one of which requires the use of a hammer whereas the other two fastening systems are formed by welding, making the tasks for replacing them long and complex.

The solutions existing in the state of the art for dredging machines have, among others, the following drawbacks:

- The teeth are solid members such that the material of said members is not optimized for the functions for which it has been designed. Another drawback of using the solid teeth known in the state of the art is that they are more difficult to handle due to their weight.
- The teeth used in the state of the art for the same application are larger, requiring more space for storage thereof.

- The interlockings between tooth and adaptor known in the state of the art have a retaining member or vertical pin assuring the attachment between said tooth and the adaptor during operation thereof. When the tooth becomes worn it is necessary to replace it and to that end the cutter head is taken out of the water and usually has material from the aquatic bed where it is working adhered to the lower part of the teeth and adaptors. Said pin is usually removed by striking said pin at the upper part and re moving it through the lower part of the tooth-adaptor assembly, which often causes the pin to fall into the water (since the tooth is changed above the water) preventing recovery thereof. Likewise, the fact that there is material adhered to the lower part of the tooth-adaptor assembly makes it difficult to remove the mentioned pin because it prevents the pin from coming out of its housing. Furthermore it is common for the pin to be lost when it is inserted in the mass of material adhered to the assembly and subsequently falling into the water.
- Due to the configuration of the interlockings existing in the state of the art, the teeth are excessively large, generating long interlockings, with less strength in the tooth, a larger occupied volume and an increase of the distance from the cutter head to the blade, which reduces the performance of the tooth and the assembly.
- The adaptor likewise has no additional protection other than the protection provided by the tooth and is affected by the materials loosened due to the action of the tooth and striking against the adaptor, causing damage and wear thereof.

DESCRIPTION OF THE INVENTION

The invention describes a tooth with a front wear part and a rear projecting part or nose intended for being housed within a hollowing arranged in the body of an adaptor and an assembly formed by both for dredging machines, both members being attached to one another by means of a preferably hammerless, preferably vertical-type, retaining system, i.e. without needing to use hammers or without having to strike the pin attaching both members to one another. The adaptor is attached to the blade of the cutter head of the dredging machine at the end opposite to the hollowing by means of a coupling adapted for such purpose.

The object of the present invention is a tooth, an adaptor and the assembly formed by both, preferably applied to dredging machinery, allowing optimal wear of the material of the tip of the tooth and coupling between the tooth and the adaptor. These objects of the invention are achieved due to a particular construction of the contact surfaces between both members, allowing the self-tightening force to be produced close to the force (load), such that the horizontal component of the rearward reaction is larger and therefore the self-tightening force is also larger since the tooth pushes against the adaptor.

In dredging operations the tooth must be replaced on the actual dredge boat, i.e. at the worksite or the operations area, usually on the water and working directly on the cutter head carrying the adaptors, or tooth bar, and the teeth. Said operations are carried out by the employees on said boat, i.e. at the work site, far from maintenance shops with the suitable conveniences and tools for optimally performing these types of operations. For this reason all the mentioned components can be coupled with fastening members and pins so that the replacement operations are simple, without an excessive number of tools and preventing the use of complex equipment.

Another object of the present invention is to present in addition to the tooth-adaptor assembly, a tooth as well as an adaptor which, due to their configuration, allow a distribution of stresses that favors retaining the tooth in the adaptor and reducing the stresses to which the retaining system, and specifically the pin thereof, is subjected. The configuration of the tooth and of the adaptor can also be used outside of dredging operations, such that the adaptor or tooth bar can be connected to the bucket of an excavating machine or the like for on-shore works.

The tooth and adaptor object of the present invention have contact surfaces and constructive features allowing the coupling between both members to increase the performance of the coupling, particularly the efficiency of each tooth, thus improving the efficiency of the dredging machine.

The tooth is made up of two different parts, a first wear part, which is the part acting on the terrain and is subject to erosion due to the terrain, and a second part or nose, which is the part that is inserted in a housing arranged for such purpose in the adaptor, forming the interlocking of the system, and subjected to the reactions and stresses generated by the work of the tooth on the terrain. Said nose is formed by a lower base body and an appendage integrated in the upper surface of said lower base body, one of its ends being free and at the opposite end said nose is attached to the wear part. The gap between the wear part and the nose is determined by the upper surfaces of the appendage and by the lower surface of the lower base body which, after reaching a maximum height from the free end of the nose, converge towards the tip of the tooth, such that the union line of both surfaces is located on the side of the wear part of the tooth and in front of the line of maximum height of the nose.

The longitudinal vertical section of the nose varies along the length thereof, and has at the free end thereof a cross-section with rounded vertices. The area of the cross-section of the nose gradually increases as the nose approaches the end for being attached to the wear part of the tooth, specifically until a maximum height is reached between the lower side of the base body and the upper side of the appendage of the base body. After this point the area of the cross-section of the nose begins to decrease until the upper surface of the appendage intersects with the lower surface of the base body.

Said section can have different shapes, such as elliptical, trapezoidal or rectangular shapes, but having at least four sides.

The appendage located in the upper part of the nose, and the trapezoidal cross-section of which is narrower than the section of the base of the nose, is centered with respect to the latter. The height of said appendage is preferably nil in an area close to the free end of the nose (although it is possible for the appendage to have a certain height at said free end) and such height gradually increases until reaching said point of maximum height before decreasing again. The lateral sides of the successive cross-sections of the appendage and the upper side of the successive cross-sections of the base body of the nose of the tooth form an angle varying, due to manufacturing issues, between 45° and an angle of less than 180°, preferably between 45° and 135°. Even more preferably the angle is greater than 90°, such that the lower base of the appendage is larger than the upper base, although the opposite is also possible, i.e. the angle is less than 90°

The nose likewise has at least one first contact area with the inner surface of the housing of the adaptor, such contact area being formed by the two upper surfaces of the base of the nose that are located on both sides of the appendage of the nose of the tooth. The main feature of this first contact area is that it achieves the self-tightening of the tooth in the adaptor.

Due to the proximity of these surfaces with the tip of the tooth, i.e. the point of application of the force produced during the work of the tooth on the terrain, causes the reactions on said surfaces to be greater and therefore the self-tightening forces (components of said reactions} are also greater.

The nose has a second contact area with the adaptor, this contact area being located on the lower surface of the base of the nose, in the area close to the free end thereof.

The adaptor is also made up of two parts: at one end it has a configuration that can vary depending on the type of machinery to which it is connected, i.e. either a cutter head of a dredging machine, or to the bucket of an excavating machine, whereas at the opposite end it has a hollowing, housing or cavity intended to receive the nose of the tooth. The inner configuration of the surfaces of the hollowing or housing of the adaptor for receiving the tooth are complementary to that of the nose of the tooth, thus assuring a perfect coupling between both members.

For the coupling between the tooth and the adaptor, both parts preferably have a hole or through borehole from the upper part of the adaptor, traversing the nose of the tooth, and to the lower part of the adaptor. A pin preferably with surfaces of revolution and with a preferably hammerless retaining system (which does not require striking with a hammer or mallet for being inserted or removed) aiding in changing teeth in the adaptor will be inserted in said housing.

The coupling of the rear part or nose of the tooth in the hollowing or housing of the adaptor is due to the conjunction of the planes defining the described locking surfaces. A tightening or crushing effect between the tooth and the adaptor is furthermore achieved by means of said planes when a stress is applied perpendicular to the wear tip of the tooth and upwardly, this being the normal working situation of the teeth in a cutter head of a dredging machine.

Due to this interlocking system, the pin is subjected to fewer stresses than in conventional interlocking systems since the to oth-adaptor system tightens itself when it is subjected to upward vertical loads in the tip of the tooth, releasing stresses into the retaining system and its pin, and therefore allowing designing pins of the retaining system with a smaller size and section since they are subjected to fewer stresses, thus reducing deterioration or mattage of the pin and allowing it to be reused.

With the described configuration of the coupling the contact surfaces between the tooth and the adaptor are closer to the working tip of the tooth than in known couplings. This reduces the lever effect created between the tooth and the adaptor, and therefore the stresses to which the assembly is subjected, including the fastening or retaining system, are also reduced, thus reducing deterioration or mattage. Reducing lever stresses in the tooth allows reducing the dimensions of the nose of said tooth. And furthermore, due to its geometry, the resistant section of the rear projection or nose decreases towards the free end thereof, such that the bending moments in said area, caused by the load at the tip of the tooth, decrease and therefore the larger moments are located at the point where the resistant section is larger. Reducing the total dimensions of the system also allows therefore reducing the height of the interlocking, thus achieving a more deeply penetrating system.

The tooth object of the invention together with the adaptor allows optimizing the wear material, i.e. the use of the material arranged in the front wear part of the tooth, which is the part that directly acts on the terrain, is optimized. Said optimization is achieved by reducing the material of the tip of the tooth that is not going to be used to a minimum. The material forming part of the tip of the tooth, or wear tip, and which is then not worn, is material that has been paid for but then not used for its purpose. The material of the tip of the tooth is optimized because the tip has been designed according to the inclination of the upper surface of the appendage of the nose, which is parallel to the line of wear of the tooth, thus making use of the largest possible amount of material at the tip of the tooth before being replaced with a new tooth.

Due to this configuration of the tooth-adaptor coupling, and taking into account that dredging operations are done "blindly" for the user, the tip of the tooth must be completely worn, the unused wear material being minimal, before the tooth bar begins to become worn, since if this occurs it causes a serious drawback both in terms of time and financial resources, since not only the tooth but also the adaptor has to be replaced. It is necessary to take into account that the wear time of the teeth further depends on the revolutions at which the cutter head works, of the material it is working on, it being difficult to predict the life of the teeth. It also so happens that once the tooth is worn, and before the tooth bar begins to be worn due to the direction action on the terrain, the user perceives increased vibrations, notifying him or her that the tip of the tooth has already been consumed. Said vibration is due to the fact that as the tooth gradually wears, the section thereof gradually increases, the section of attack of the tooth on the terrain therefore being increasingly larger, causing the mentioned vibration since the optimal section for penetration has been consumed, such that when the entire section of the tip of attack has been consumed and the tooth bar is reached, said vibration is very large notifying the operators that it is necessary to replace the tooth.

Another object of the invention consist of the tooth being able to have between the front wear part and the nose for coupling to the adaptor, according to the previously defined inclined planes, a perimetral projection or flange or collar, the main purpose of which is to protect the contact area between the tooth and the adaptor from the material loosened during its dredging operation. Said collar also carries out three functions in the coupling:

- Protecting the adaptor from wear through the deflectors in the upper and lower areas and which have been designed to redirect the flow of loosened material, preventing such material from rubbing or striking against the adaptor and therefore preventing the wear thereof,
- Preventing the loosened material from entering into the interlocking, acting as a plug and also reducing the entrance of material in the fastening or retaining system, and
- Making contact with the adaptor after prolonged wear through stoppers located in the upper and lower areas, said stoppers being thicker to resist the larger stresses to which it is subjected when contact with the adaptor is made, determining a third contact area between the tooth and the adaptor.

Said collar can have variable thicknesses along its length depending on the stresses to which it is subjected during the work of the coupling. Specifically, said collar has the thickest areas in its upper and lower area such that when contact is made, the reactions of the tooth bar on the collar exert a component directly opposing the applied force (Fc). In addition the middle area of the collar has a curve towards the tip of the tooth that adapts to the shape of the interlocking, according to the parallelism to planes S and I and allowing the contact areas to be closer to the tip of the tooth, this area being where the main contact areas, located close to said tip to also reduce the lever effect, are located. Said central areas have less thickness than in the upper and lower areas.

Another object of the invention is a tooth the nose of which is hollow, such that the amount of material that is worn out is reduced.

DETAILED DESCRIPTION OF THE DRAWINGS

To complement the description being made and for the purpose of aiding to better understand the features of the invention, according to a preferred practical embodiment thereof, a set of drawings is attached as an integral part of said description which show the following with an illustrative and non-limiting character:

DESCRIPTION OF A PREFERRED EMBODIMENT

Figure 1:
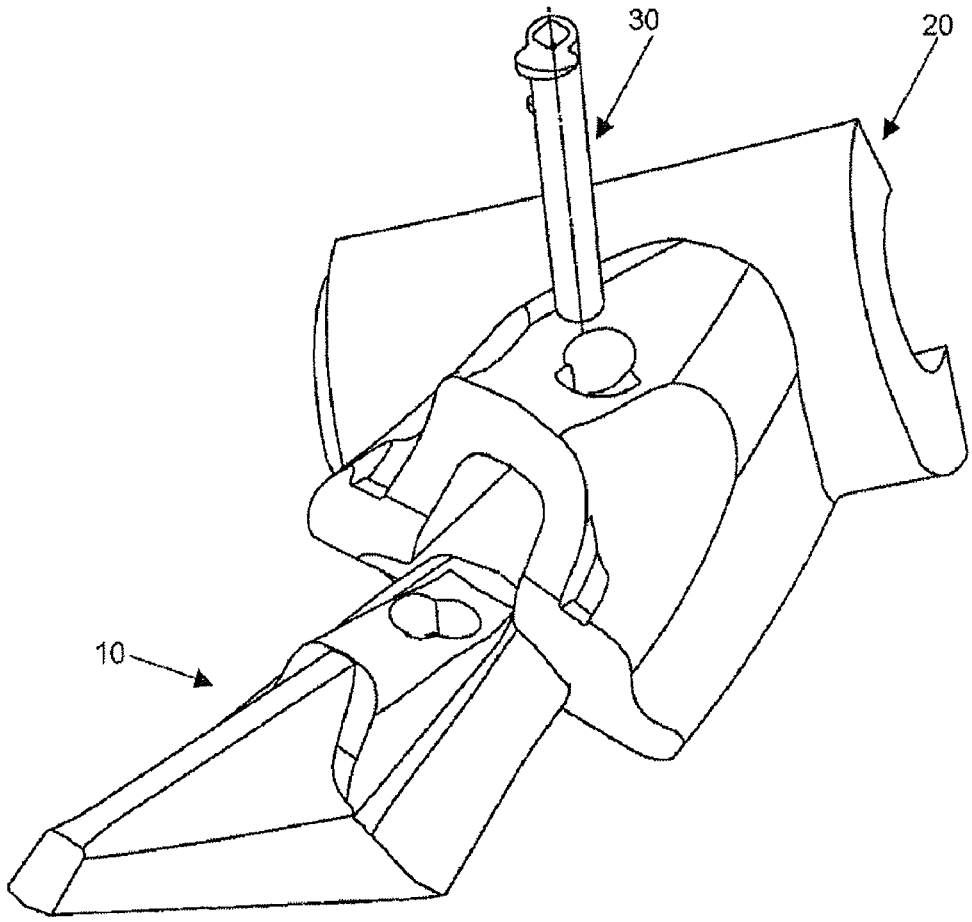
FIG. 1 depicts a perspective view of a collarless tooth and an adaptor prior to their coupling.
Figure 2:
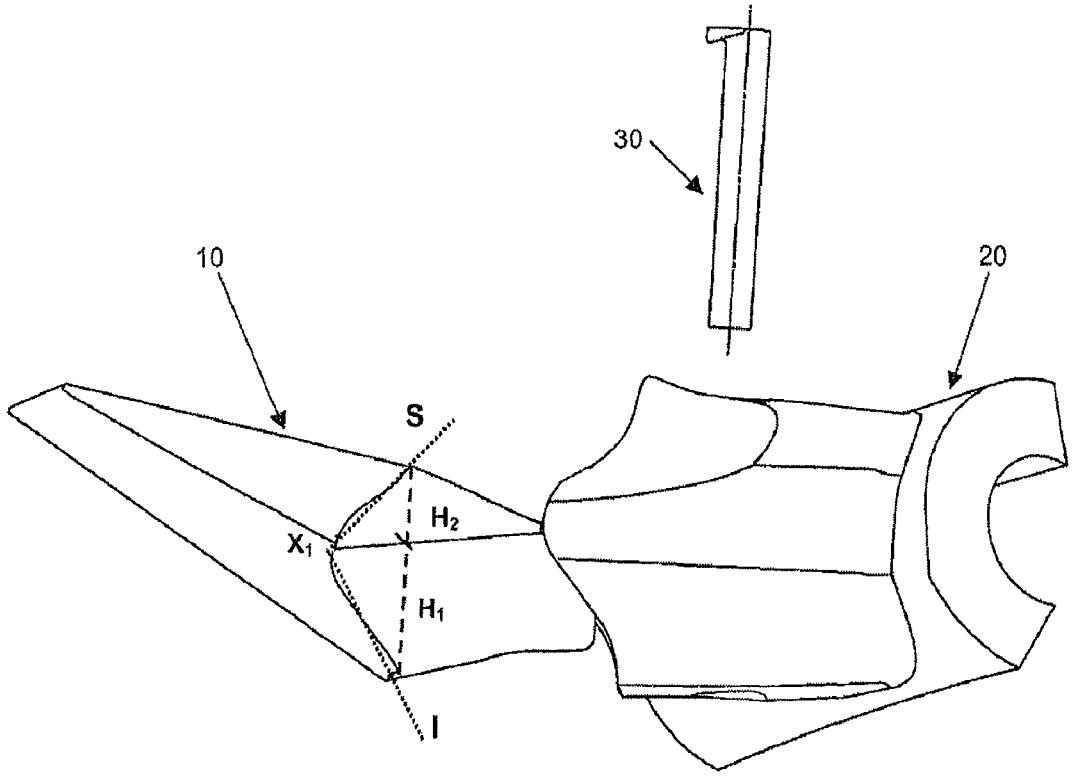
FIG. 2 depicts a side elevational view of a collarless tooth and an adaptor prior to their coupling.

As observed in FIG. 1, the invention object of the present application, tooth and adaptor for dredging, is formed by an interchangeable tooth 10, an adaptor 20 coupled to a blade of a cutter head of a dredging machine, and a retaining member 30 responsible for assuring the connection between the tooth and the adaptor.

Figure 3:
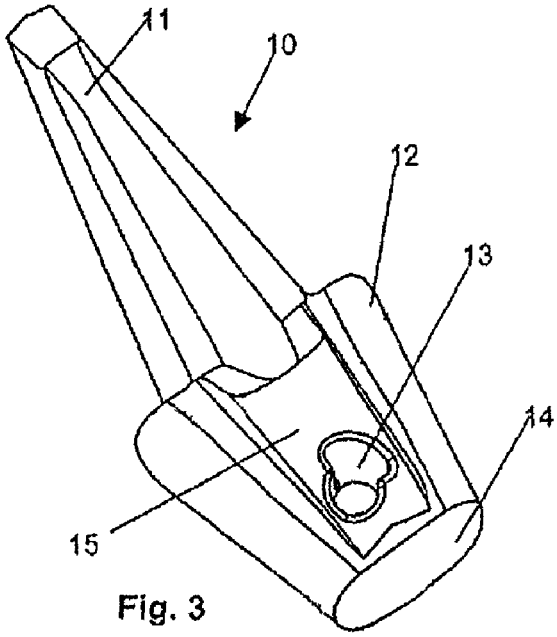
FIG. 3 depicts a perspective view of a collarless tooth.
Figure 20:
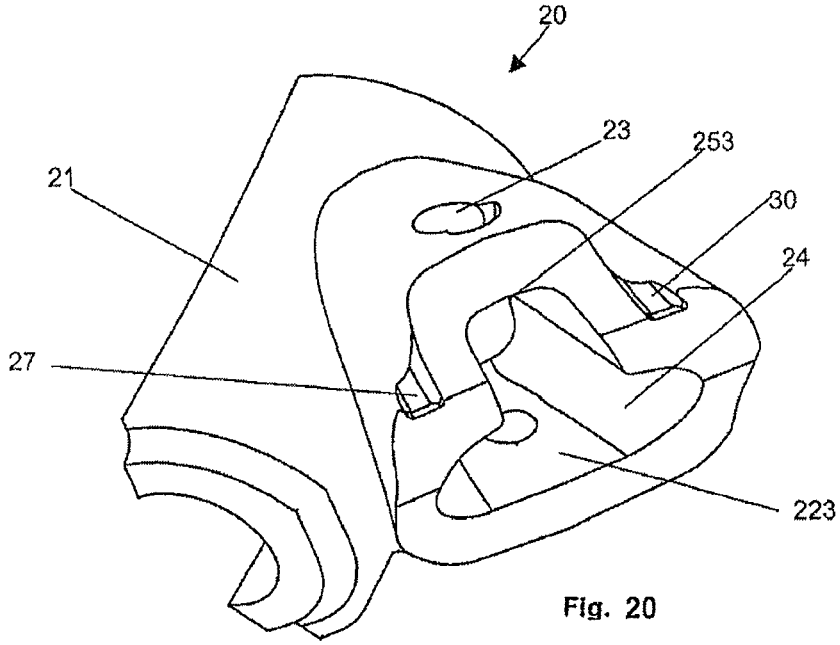
FIG. 20 depicts a perspective view of an adaptor.
Figure 21:
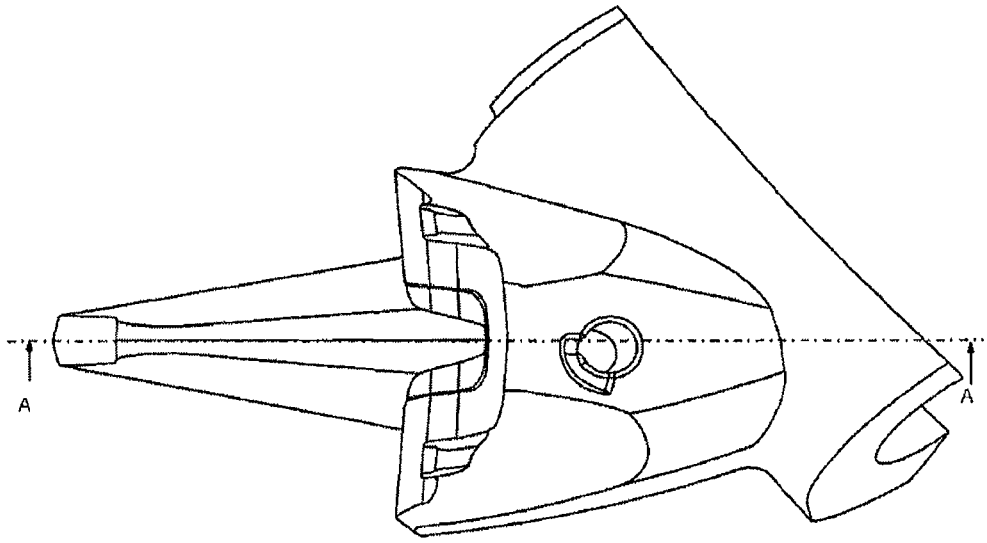
FIG. 21 depicts a view of an adaptor.

As can be observed in FIG. 3 and FIG. 20, the tooth 10 consists of a front wear part 11 or tip of the tooth responsible for the task of eroding the terrain, in contact with the ground and stones, and in its rear part it has a projection or nose 12 intended for being housed in a housing or hollowing 24 arranged in the adaptor 20.

Figure 4:
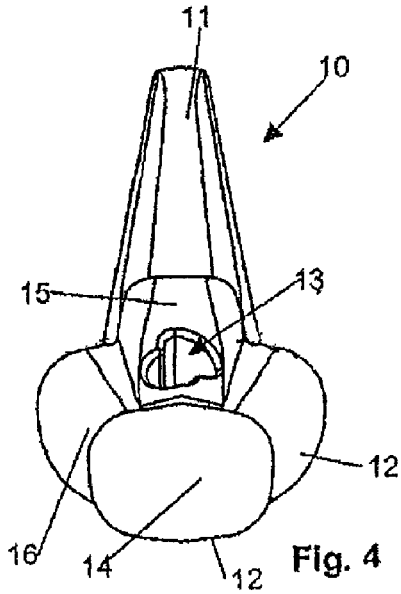
FIG. 4 depicts the rear elevational view of a collarless tooth.
Figure 5:
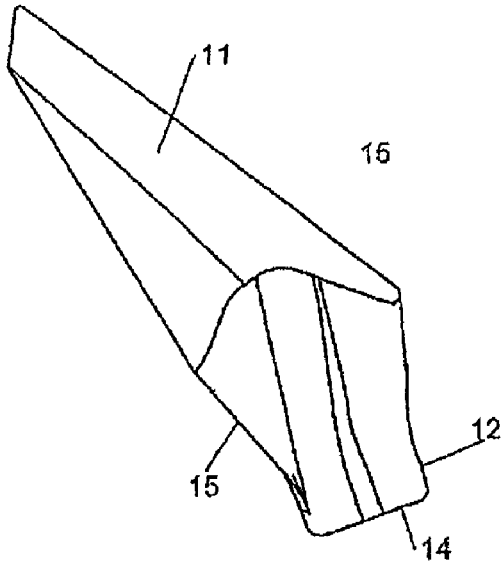
FIG. 5 depicts a side elevational view of a collarless tooth.
Figure 6:
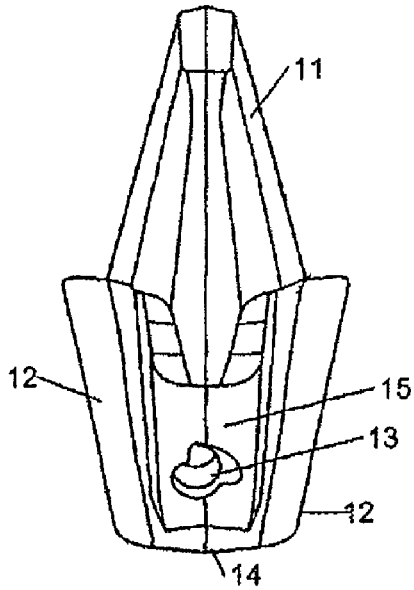
FIG. 6 depicts a plan view of a collarless tooth.
Figure 7:
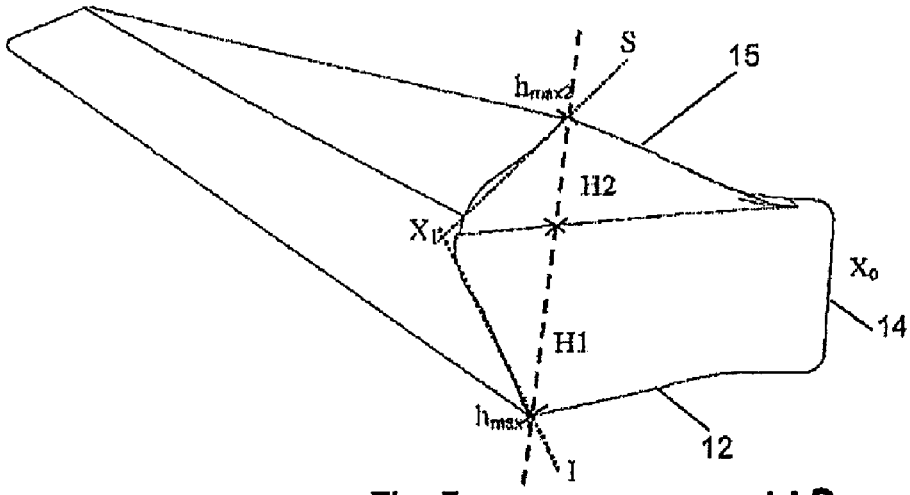
FIG. 7 depicts a side elevational view of a collarless tooth showing the inclined planes S and I.
Figure 8:
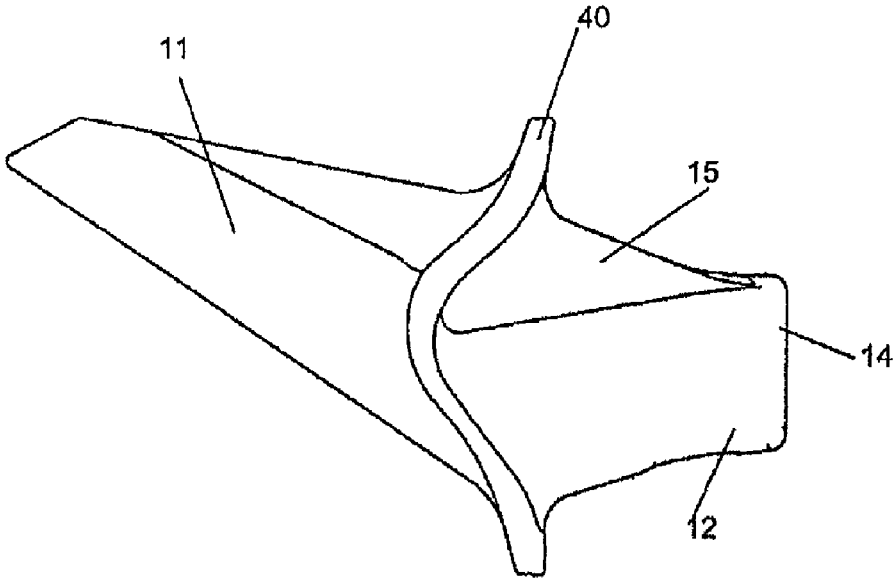
FIG. 8 depicts a side elevational view of a tooth with a collar.
Figure 9:
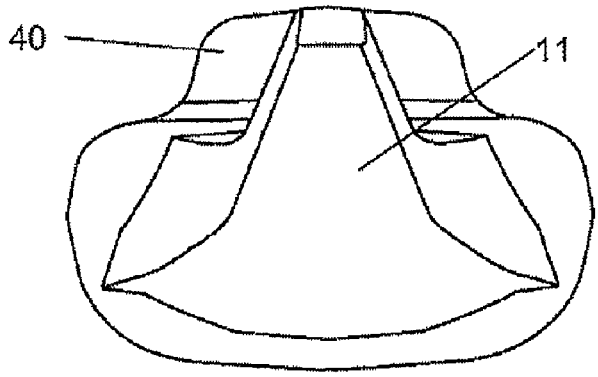
FIG. 9 depicts a front elevational view of a tooth with a collar.
Figure 10:
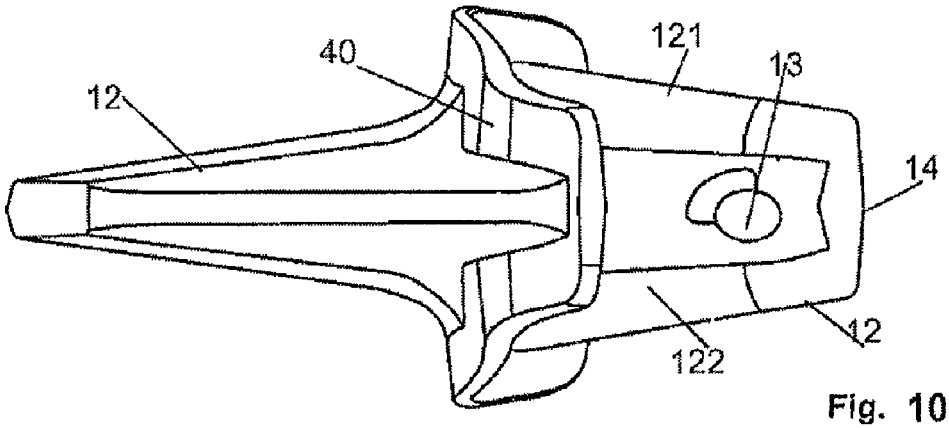
FIG. 10 depicts a plan view of a tooth with a collar.
Figure 11:
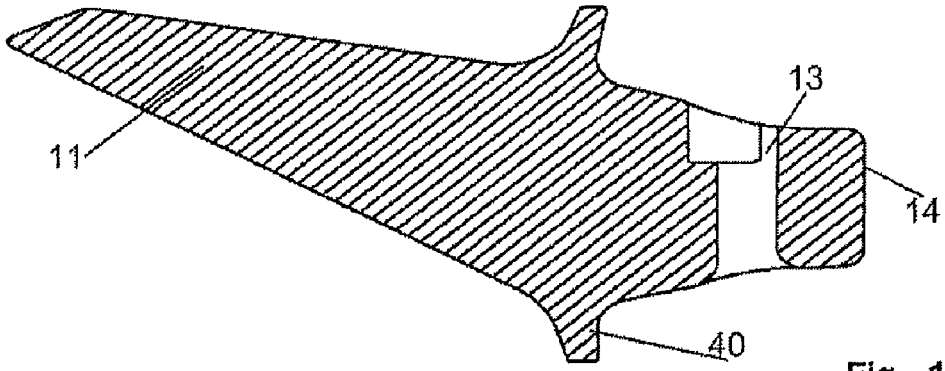
FIG. 11 depicts a cross-section of a solid tooth with a collar.

FIG. 4 shows how the nose 12 of the tooth is formed by a lower base body 16 and an appendage 15 integrated in its upper surface, with a free end 14 attached at the end opposite to the front wear part, said nose 12 being separated from the wear part by the intersection of the upper surfaces of the appendage and the lower surface of the base body. More specifically, the gap between the wear part 11 and the nose 12 is determined by the two inclined planes S, I determined by said upper surfaces of the appendage and lower surface of the base body, such that the imaginary horizontal intersection line of both planes $\mathbf{1}_1$ is located in front of the vertical line ($h_{max1}$-$h_{max2}$) determining the maximum height of the tooth 10, located in the side opposite to that of the free end of the nose 14. Said maximum height of the tooth H3 is formed by the maximum height of the base body H1 combined with the maximum height of the appendage H2.

According to a first vertical plane XY varying along the horizontal axis x, the base body of the nose, FIG. 13 to FIG. 19, has a cross-section at the free end $x_0$, according to a second vertical plane YZ, with a rectangular shape with rounded vertices such that the area of the cross-section, along the horizontal axis x, of the nose 12 gradually increases as the nose approaches the end for being attached to the wear part of the tooth, inclined planes S, I, specifically until the lower surface of the nose intersects the lower inclined plane I, after the point where the area of the cross-section along the horizontal axis x of the nose begins to decrease again until the intersection $x_1$ of the inclined upper S and lower I planes.

Figure 27:
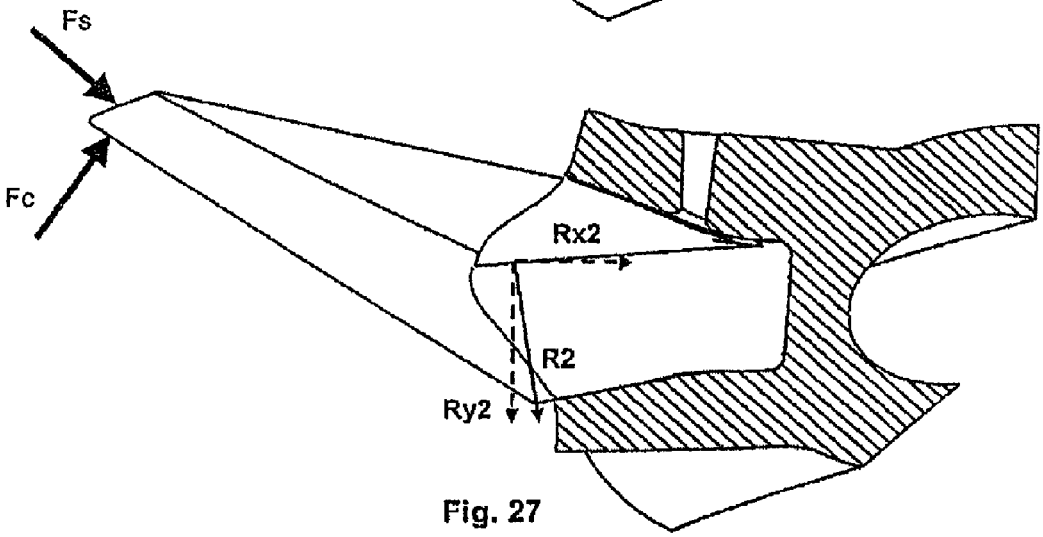
FIG. 27 depicts a collarless tooth in which the appendage of the nose of said tooth has a certain height along its entire length.

In addition, the section of the appendage 15 of the nose 12 of the tooth 10 has a trapezoidal cross-section, its lower base being narrower than the upper surface of the base body of the nose 16 and centered with respect to said base body 16, such that the height of said appendage is nil in an area close to the free end 14 of the nose $x_0$, and its height gradually increases until reaching a maximum height H2, at which point the upper surface of said appendage 15 and therefore of the nose 12 intersects the upper inclined plane S of separation with the wear part of the tooth 11, the height of the appendage decreasing after this point until reaching the intersection $x_1$ of the upper S and lower I inclined planes. Said appendage 15 could also not have nil height at the free end of the nose 14 (see FIG. 27), or not be centered with respect to the base of the nose 16.

The lateral sides 151, 152 of the successive cross-sections of the appendage 15 and the upper side 121, 122 of the successive cross-sections of the base of the nose 16 of the tooth 10 form an angle varying between 45° and 180°, preferably between 45° and 135°, and even more preferably greater than 90°.

According to the foregoing, the description provides that the nose of the tooth 10 has a lower base body 16, with a section of at least four sides (a, b, c, d) with rounded vertices and with an upper surface 120 and a lower surface 123. On said lower base body 16 there is an upper appendage 15 with an upper surface 153 and a lower surface 154, and with a trapezoidal section the lower base 154 of which is larger than the upper base 153 and the lower base 154 is in turn narrower than the upper surface 120 of the lower base body 16 and is centered with respect to the upper surface 120 of the lower base body 16. The nose also has a free end 14, opposite to the front wear part or tip 11, and an end opposite to the mentioned free end and attached to the tip 11 of the tooth 10.

The nose of the tooth and its section, as well as that of the area of attachment with the front part of the tooth or tip of the tooth, is determined by the progressive gap of the upper 120 and lower 123 surfaces of the lower base body 16 starting from a point close to the free end 14 of the nose 12 and therefore increasing the section of said base body 16 in the direction of the tip of the tooth 11, until defining a maximum gap H1 corresponding with the maximum height H1) of the lower base body 16. The upper 153 and lower 154 surfaces of the appendage 15 also progressively separate from one another from a point close to the free end 14 of the nose 12, thus increasing the section of said appendage 15 in the direction of the tip of the tooth 11, until determining a maximum gap H2 defining the maximum height H2 of the appendage 15. The union of the maximum heights H1, H2 of the lower base body 16 and of the appendage 15, determine a line of maximum height H3 of the nose of the tooth 12, such that after said line of maximum height H3 the upper surface 153 of the appendage 15 and the lower surface 123 of the lower base body 16 begin to converge towards the tip 11 of the tooth 10 until the union of both surfaces 153, 123, the union line of both surfaces 11 being located on the side of the wear part of the tooth 11 and in front of the line of maximum height H3. Said maximum height is located at a balance point between good penetration of the system, which as mentioned depends on the total height of the nose, and of the resistance of the system, which depends on the stresses to which it is subjected.

Figure 22:
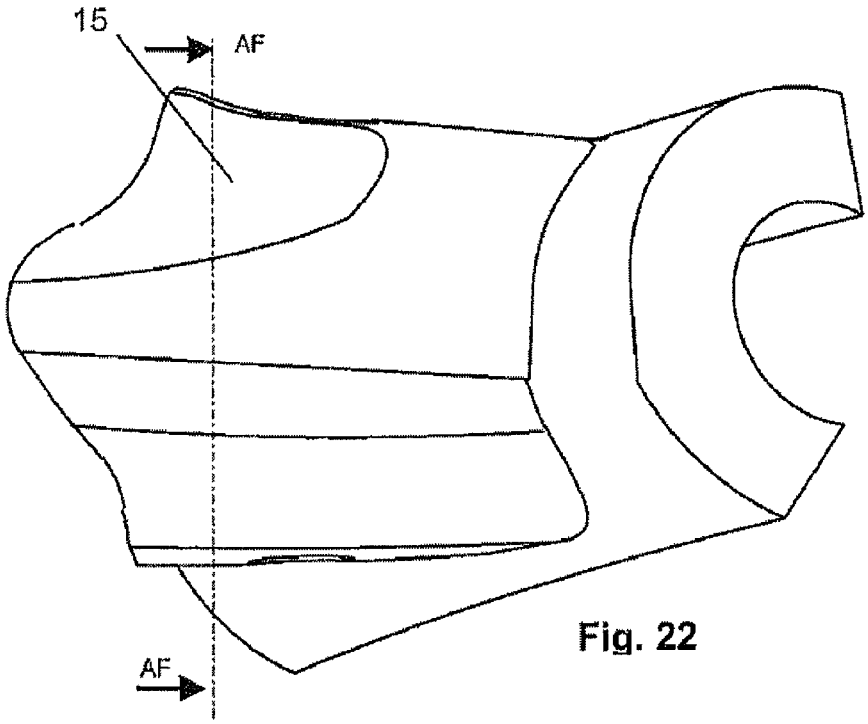
FIG. 22 depicts a rear view of an adaptor.
Figure 23:
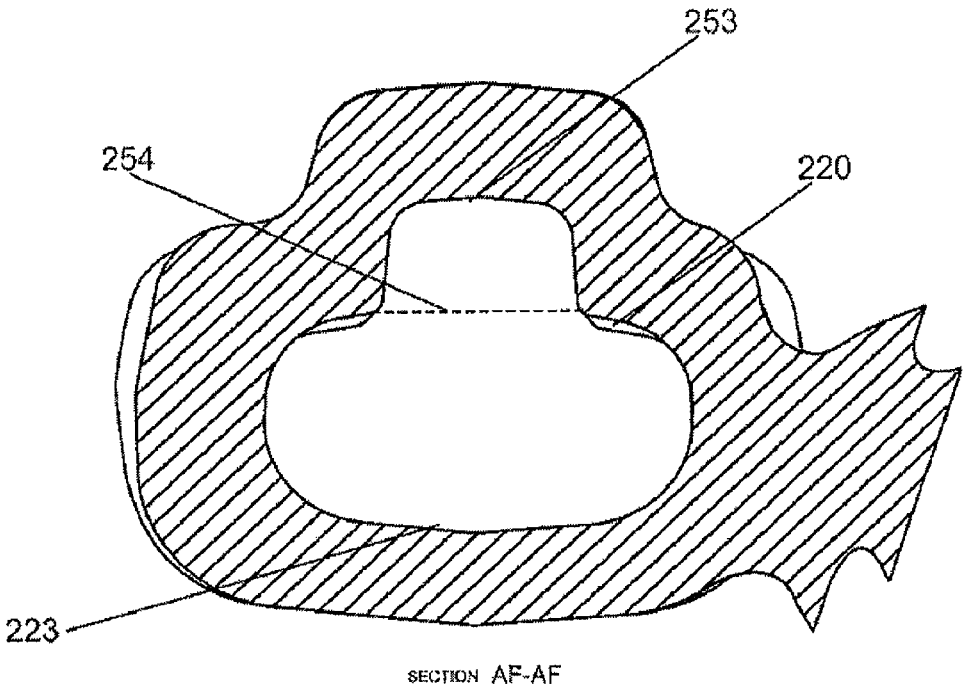
FIG. 23 depicts a section, according to AB-AB, of the adaptor of FIG. 22, showing the inclined planes SA and IA.

The adaptor, FIG. 20, is formed by a body having a coupling 21 at one end to be attached to a blade of the cutter head of a dredging machine and at the opposite end it has a hollowing or housing 24 for receiving the rear projecting part or nose 12 of a tooth 10, which is inserted in said housing 24. The inner surfaces, FIG. 22, of said housing 24 of the adaptor 20 are complementary to the surfaces of the nose 12 of the tooth 10. In other words, said housing 24 is formed by a lower base hollow 22 and an inverted T-shaped appendage in its upper surface 25 in the opening 28 of the housing 24 coinciding with the free end thereof. The shape of said free end or opening 28 is defined by two inclined planes, an upper plane SA and another lower plane IA, which correspond with the upper surface of the hollow appendage and with the lower surface of the base hollow of the nose, intersecting at their intersection line (or point) 12 formed by the infinite points $x_3$ of the intersection of the planes, such that the intersection line $\mathbf{1}_2$ of both planes is in front of the line ($h_{max1}$-$h_{max2}$) determining the maximum height A3 of the hollowing 24, as shown in FIG. 23.

As previously described, the inner surfaces are complementary to that of the nose of the tooth, therefore the infinite sections of said housing are complementary to the infinite sections of the nose of the tooth such that according to a first vertical plane XY, which varies along the horizontal axis x, the hollowing has at the bottom 26 of the hollowing 24, opposite to the opening 28, a cross-section, according to a second vertical plane YZ, with rectangular shape with rounded vertices, such that the area of the cross-section of the hollowing 24 gradually increases as it approaches the opening 28 of the hollowing 24 (planes SA, IA), specifically until the lower side of the hollowing 24 intersects with the lower inclined plane IA, such that after this point the area of the cross-section of the hollowing 24 begins to decrease again until the intersection $x_3$ of the inclined upper SA and lower IA planes.

Likewise the section of the upper appendage 25 of the hollowing 24 has a trapezoidal cross-section, narrower than the base of the hollowing 22, and centered with respect to same 22, such that the height of said appendage is nil in an area close to the bottom of the hollowing 26, and its height gradually increases until the upper surface of said appendage 25 intersects with the upper inclined plane SA of separation, the height of the appendage 25 decreasing after this point until reaching the intersection $x_3$ of the inclined upper SA and lower IA planes. Likewise, the upper appendage 25 may not end in its area close to the bottom of the hollowing 26 with nil height, but rather with certain height, and it could also not be centered with respect to the base of the hollowing 22.

Obviously as in the nose 12 of the tooth 10, the lateral sides 251, 252 of the successive cross-sections of the appendage 25 and the upper side 221, 222 of the successive cross-sections of the base of the hollowing 22 forms an angle with one another varying between 45° and 180°, preferably between 45° and 135°. Even more preferably said angle is greater than 90°.

In other words, the adaptor 20 has at the end opposite to that of the coupling 21 a hollowing or housing 24 for receiving the rear projecting part or nose 12 of a tooth 10, which is completely inserted in said housing 24. Said housing 24 is formed by a lower base hollow or hollowing 22 having a section of at least four sides with rounded vertices, an upper surface 220 and a lower surface 223, arranging on said upper surface a hollow upper appendage 25 forming the housing 24 of the nose 12 of the tooth 10. Said hollow appendage 25 is formed by an upper surface 253 and a lower surface 254, and it also has a trapezoidal section the lower base 254 of which is larger than the upper base 253 and such lower base 254 is in turn narrower than the upper surface 220 of the lower base hollow 22, said hollow appendage 25 being centered with respect to the upper surface 220 of the lower base body 22. The housing 24 has an opening 28 at the end opposite to the end for coupling the adaptor to the, and an end opposite to that of the opening 28 forming the bottom 26 of the housing 24, and therefore located close to the coupling to the blade. The housing 24 of the adaptor 20 is also determined by the upper 220 and lower 223 surfaces of the lower base hollowing 22 which progressively separate from one another from a point close to the bottom of the hollowing 26 of the adaptor 20, such that the section of said base hollowing 22 gradually increases in the direction of the opening 28 of the adaptor 20 until a maximum gap A1 is defined, corresponding with the maximum height A1 of the lower base hollowing 22. The upper 253 and lower 254 surfaces of the hollow upper appendage 25 progressively separate from one another from a point close to the bottom of the hollowing 26 of the adaptor 20, the section of said hollow appendage 25 thus increasing in the direction of the opening 28 of the adaptor 20, until determining a maximum gap A2 defining the maximum height A2 of the hollow appendage 25. The union of both heights A1, A2 of the lower base hollowing 22 and of the hollow appendage 25 determine a line of maximum height A3 of the opening 24 of the housing 24 of the adaptor 20. After said line of maximum height A3 the upper surface 253 of the hollow appendage 25 and the lower surface 223 of the lower base hollowing 22 begin to converge in the direction opposite to that of the bottom of the hollowing 26 until the union of both surfaces 253, 223, the union line of both surfaces 12 being located on the opposite side of the bottom of the hollowing 26 and in front of the line of maximum height A3 of the opening 28 of the hollowing 24 of the adaptor 20.

Figure 24:
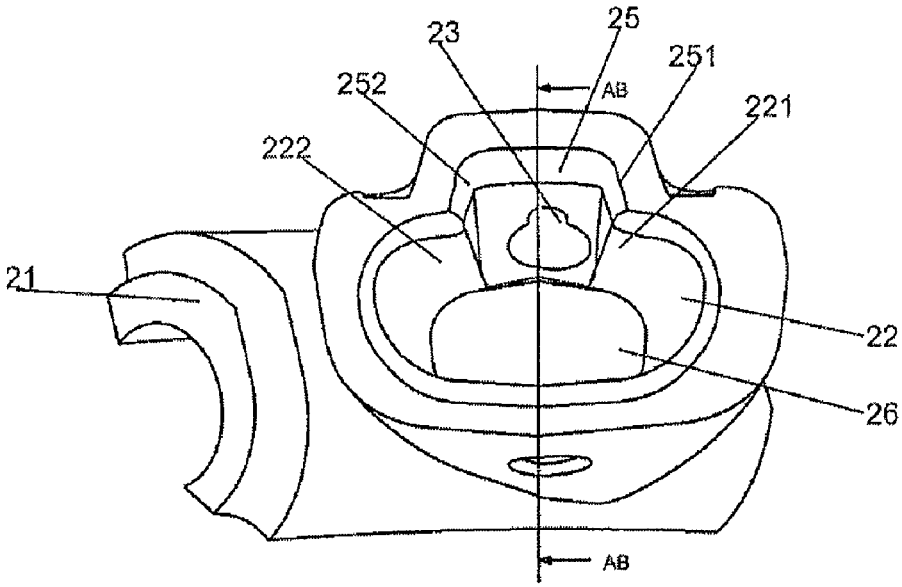
FIG. 24 depicts a view of a collarless tooth and an adaptor coupled together.
Figure 25:
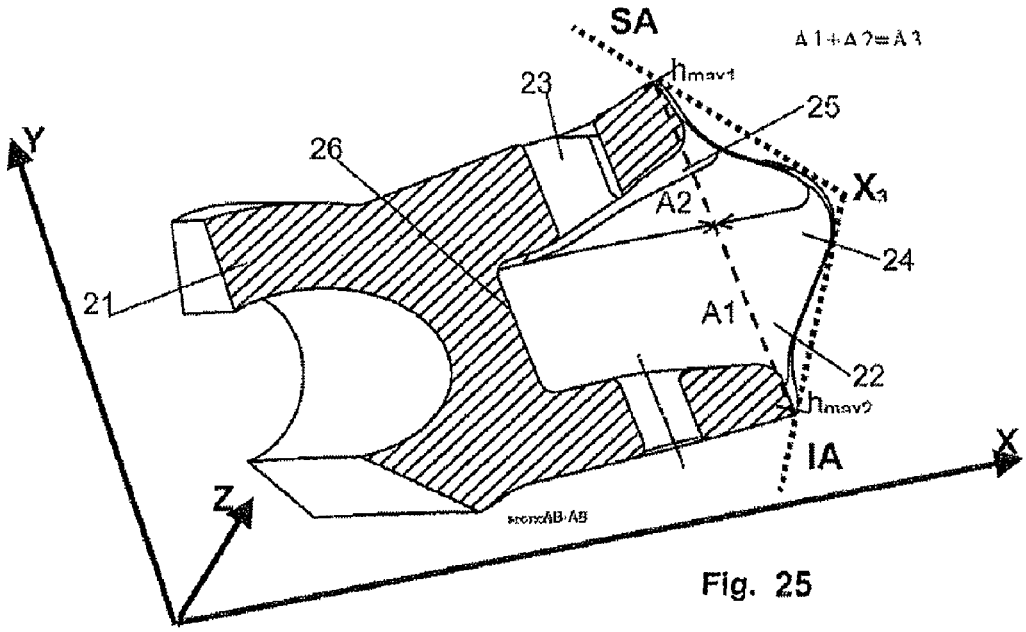
FIG. 25 depicts a section, according to AE-AE, of the coupling between a collarless solid tooth and an adaptor shown in the FIG. 24.
Figure 26:
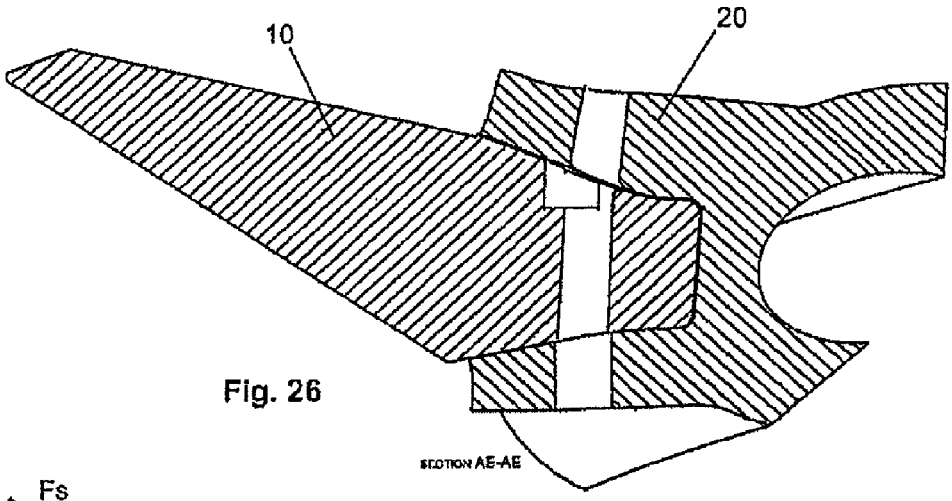
FIG. 26 depicts a collarless tooth and an adaptor coupled together showing the forces to which the assembly may be subjected and its reactions.

As shown in FIG. 24 and FIG. 25, both members are coupled together by inserting the nose 12 of the tooth 10 into the housing 24 of the adaptor 20, the different complementary surfaces of the nose 12 and of the housing 24 coming into contact with one another.

At the same time the adaptor 20 has been installed through its coupling 21 in the blade or propeller of the cutter head of the dredging machine, the tooth 10 is installed, using for that purpose a preferably hammerless retaining member 30, i.e. a member that does not require the action of a mallet or hammer for removing it from or inserting it in the housings intended for such purpose in the tooth and in the adaptor. The retaining system is vertical, being inserted and removed through the upper part of the tooth and of the adaptor, traversing the nose 12 of the tooth 10 and the body of the adaptor 20 through respective through holes 13, 23.

Once the assembly is put together and during the working operations, the tooth 10 is subjected at its tip 11 to an upward perpendicular force (Fc) in the lower side of the tip of the tooth 11, less commonly being able to be subjected to a force normal Fs to the tip of the tooth due to the swell of the boat, causing a series of stresses and reactions in the coupling between the tooth 10 and the adaptor, specifically in the contact surfaces between both.

The first contact area between both is formed by the two surfaces, both in the tooth and the adaptor, coming into contact with one another, specifically those which are located on both sides of the appendage 15 of the nose 12 of the tooth 10 or of the appendage 25 of the hollowing 24 of the adaptor 20, i.e. surfaces 121, 122 in the tooth 10 and surfaces 221, 222 in the adaptor 20. This first contact area, which is very close to the tip of the tooth 11, generates self-tightening reaction Rx2 preventing the tooth 10 from being ejected from the adaptor 20 due to the stresses to which it is subjected. It is also possible that there is only one first contact surface between the tooth 10 and the adaptor 20, for example in the case in which the appendage 15 of the nose 12 of the tooth 10 is not centered with respect to the base of the nose 16 of the tooth 10.

A constructive alternative in the tooth 10 consists of arranging a collar or flange 40 therein (see FIG. 8 to FIG. 11), located on the perimeter of the tooth and coinciding with the gap previously defined between the front part of the tooth or tip 11 thereof and the beginning of the nose 12 of the tooth 10. The thickness or width of said collar 40 varies depending on the area of the tooth it surrounds depending on the stresses to which said area is subjected.

Figure 12:
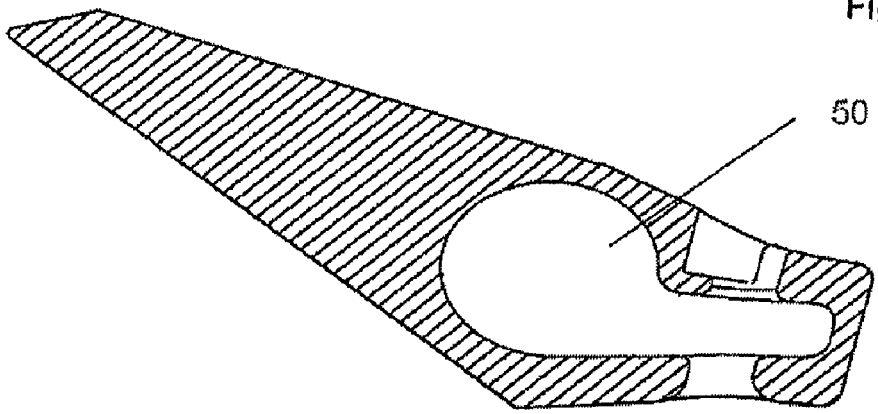
FIG. 12 depicts a cross-sectional view of a hollow collarless tooth.
Figure 13:
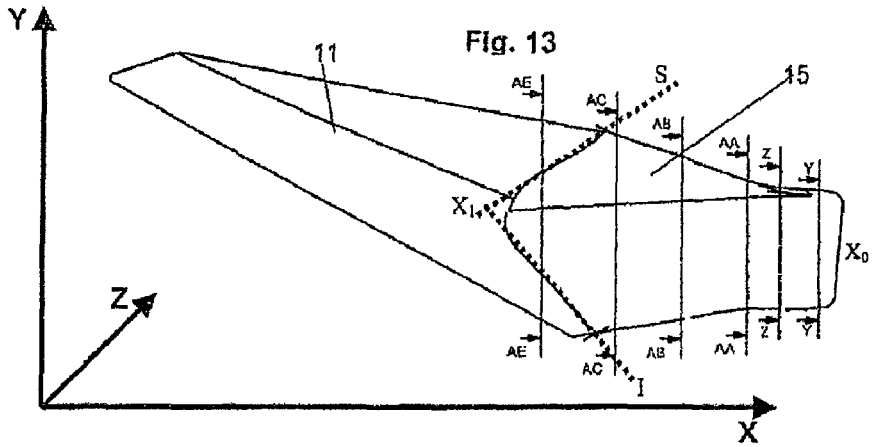
FIG. 13 depicts a side elevational view of a collarless tooth.
Figure 14:
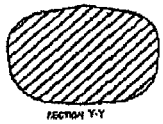
FIG. 14 depicts a section, according to Y-Y, of the hollow collarless tooth of FIG. 13.
Figure 15:
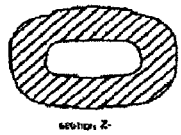
FIG. 15 depicts a section, according to Z-Z, of the hollow collarless tooth of FIG. 13.
Figure 16:
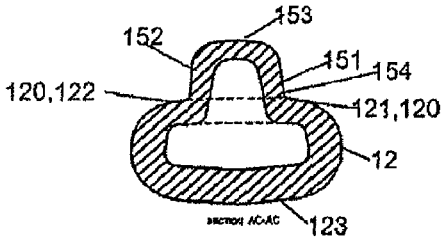
FIG. 16 depicts a section, according to AC-AC, of the hollow collarless tooth of FIG. 13.
Figure 17:
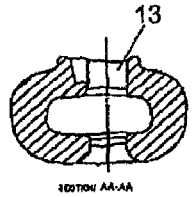
FIG. 17 depicts a section, according to AA-AA, of the hollow collarless tooth of FIG. 13.
Figure 18:
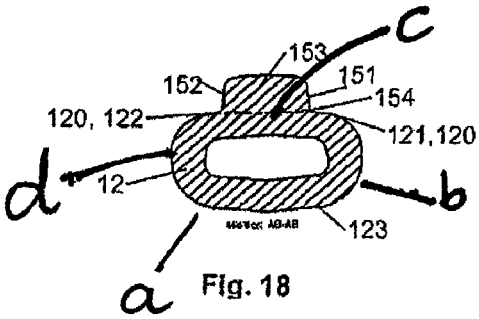
FIG. 18 depicts a section, according to AB-AB, of the hollow collarless tooth of FIG. 13.
Figure 19:
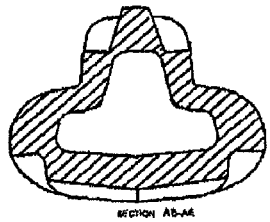
FIG. 19 depicts a section, according to AE-AE, of the hollow collarless tooth of FIG. 13.

Another feature of the tooth 10 object of the present invention is that the nose 12 of the tooth 10 has a hollowing or cavity 50 to reduce the weight of the tooth without affecting its mechanical features (see FIG. 12).

It should be mentioned that the adaptor has at least one groove 27 in its contact area with the tooth for inserting a tool and aiding in removing the tooth once the retaining member arranged between both has been removed.

The invention claimed is:

1. A tooth for being connected to an adaptor by a retaining system, said tooth having a front wear part or tip intended for being in contact with dirt and stones, and a rear coupling part, said rear coupling part is a projection or nose comprising:

a lower base body, with a section of at least four sides with rounded vertices and with an upper surface and a lower surface, an upper appendage arranged on the lower base body, with an upper surface and a lower surface forming an upper base and lower base of a trapezoidal section, respectively, the lower base being narrower than the upper surface of the lower base body and being centered with respect to the upper surface of the lower base body, a free end opposite to the front wear part or tip, and an end opposite to the free end and attached to the tip of the tooth, wherein the upper and lower surfaces of the lower base body progressively separate from one another from a point close to or at the free end of the nose, the section of said lower base body increasing in the direction of the tip of the tooth until defining a maximum gap corresponding with the maximum height of the lower base body, and the upper and lower surfaces of the appendage progressively separate from one another from a point close to or at the free end of the nose, the section of said appendage increasing in the direction of the tip of the tooth until determining a maximum gap defining the maximum height of the appendage, such that the union of the maximum heights of the lower base body and of the appendage determine a line of maximum height of the nose of the tooth, such that after said line of maximum height of the nose of the tooth, the upper surface of the appendage and the lower surface of the lower base body begin to converge towards the tip of the tooth until the union of both surfaces at a union line, the union line of both surfaces being located on the side of the wear part of the tooth and in front of the line of maximum height of the nose of the tooth.

2. A tooth according to claim 1, wherein the upper and lower surfaces of the lower base body of the nose progressively separate from one another from the free end of the nose.

3. A tooth according to claim 1, wherein the upper and lower surfaces of the appendage progressively separate from one another from the free end of the nose.

4. A tooth according to claim 1, comprising a collar or flange located in a perimeter of the tooth and coinciding with the gap between said front wear part of the tooth or tip and said rear part or nose.

5. A tooth according to claim 4, wherein the collar has a variable thickness or width in different areas of a perimeter of the collar.

6. A tooth according to claim 5, wherein the thickness of the collar is greater in upper and lower areas of the collar to resist stresses when contact is made between these areas of greater thickness and the adaptor.

7. A tooth according to claim 4, wherein the collar has a constant thickness or width.

8. A tooth according to claim 1, wherein the nose of the tooth is hollow to reduce the weight of the tooth.

9. A tooth according to claim 1, wherein the nose has a vertical housing for housing a vertical pin for retaining the tooth with the adaptor.

10. A tooth according to claim 9, wherein said pin does not require the use of blows with a mallet or hammer for inserting the pin in or removing the pin from the housing.

11. A tooth according to claim 1, wherein the lower base of the appendage is larger than the upper base of the appendage.

12. The tooth according to claim 1, wherein the tooth is configured for use with an adaptor configured to attach the tooth to a propeller of a dredging machine.

13. An adaptor for being coupled with a tooth, having a coupling at one end and at an end opposite to that of the coupling a housing for receiving a rear projecting part or nose of the tooth, which is completely inserted in said housing, said housing being formed by:

a lower base hollow with a section of at least four sides with rounded vertices, an upper surface and a lower surface, a hollow upper appendage, with an upper surface and a lower surface, arranged on the lower base hollow and connected thereto, forming the housing of the nose of the tooth, and a trapezoidal section the upper and lower bases of which are respectively determined by the upper and lower surfaces of the housing, the lower base being narrower than the upper surface of the lower base hollow and said hollow appendage being centered with respect to the upper surface of the lower base body, an opening at an end opposite to the end for coupling to the blade, and a bottom of the hollow, located at the end opposite to that of the opening and close to the coupling to the blade, wherein the upper and lower surfaces of the lower base hollow progressively separate from one another from a point close to the bottom of the hollow of the adaptor, the section of said base hollow increasing in the direction of the opening of the adaptor until defining a maximum gap corresponding with a maximum height of the lower base hollow, and the upper and lower surfaces of the hollow upper appendage progressively separate from one another from a point close to the bottom of the hollow of the adaptor, the section of said hollow appendage increasing in the direction of the opening of the adaptor until determining a maximum gap defining a maximum height of the hollow appendage, such that the union of the maximum heights of the lower base hollow and of the hollow appendage determine a line of maximum height of the opening of the housing of the adaptor, such that from said line of maximum height the upper surface of the hollow appendage and the lower surface of the lower base hollowing begin to converge in the direction opposite to that of the bottom of the hollowing until the union of both surfaces form a union line located on an opposite side of the bottom of the hollow and in front of the line of maximum height of the opening of the hollow of the adaptor.

14. An adaptor according to claim 13, comprising at least one groove in a contact area of the adaptor with the tooth for inserting a tool and aiding in removing the tooth.

15. An adaptor according to claim 13, wherein the adaptor has a vertical housing for housing a vertical pin useful for retaining the tooth with the adaptor.

16. An adaptor according to claim 13, wherein said pin does not require the use of blows with a mallet or hammer for inserting the pint in or removing the ping from the housing.

17. An adaptor according to claim 13, wherein the lower base of the hollow appendage is larger than the upper base thereof.

18. An adaptor according to claim 13, wherein the outer contour of the hollow has the same section as that of the hollow.

19. The adaptor according to claim 13, configured to be attached to a blade of a cutter head of a dredging machine.

20. A tooth and adaptor assembly for being connected to a dredge, comprising:

a tooth having a front wear part or tip intended for being in contact with dirt and stones, and a rear coupling part, wherein said rear coupling part is a projection or nose has comprising:

a lower base body, with a section of at least four sides with rounded vertices and with an upper surface and a lower surface, an upper appendage arranged on the lower base body, with an upper surface and a lower surface forming an upper base and a lower base of a trapezoidal section, respectively, the lower base being narrower than the upper surface of the lower base body and being centered with respect to the upper surface of the lower base body, a free end opposite to the front wear part or tip, and an end opposite to the free end and attached to the tip of the tooth, wherein the upper and lower surfaces of the lower base body progressively separate from one another from a point close to or at the free end of the nose, the section of said lower base body increasing in the direction of the tip of the tooth until defining a maximum gap corresponding with the maximum height of the lower base body, and the upper and lower surfaces of the appendage progressively separate from one another from a point close to or at the free end of the nose, the section of said appendage increasing in the direction of the tip of the tooth until determining a maximum gap defining the maximum height of the appendage, such that the union of the maximum heights of the lower base body and of the appendage determine a line of maximum height of the nose of the tooth, such that after said line of maximum height of the nose of the tooth, the upper surface of the appendage and the lower surface of the lower base body begin to converge towards the tip of the tooth until the union of both surfaces at a union line, the union line of both surfaces being located on the side of the wear part of the tooth and in front of the line of maximum height of the nose and the tooth;

an adaptor for being coupled with the tooth, having a coupling at one end and at an end opposite to that of the coupling a housing for receiving a rear projecting part or nose of the tooth, which is completely inserted in said housing, said housing being formed by:

a lower base hollow with a section of at least four sides with rounded vertices, an upper surface and a lower surface, a hollow upper appendage, with an upper surface and a lower surface, arranged on the lower base hollow and connected thereto, forming the housing of the nose of the tooth, and a trapezoidal section the upper and lower bases of which are respectively determined by the upper and lower surfaces of the housing, the lower base being narrower than the upper surface of the lower base hollow and said hollow appendage being centered with respect to the upper surface of the lower base body, an opening at an end opposite to the end for coupling to the blade, and a bottom of the hollow located at the end opposite to that of the opening and close to the coupling to the blade, wherein the upper and lower surfaces of the lower base hollow progressively separate from one another from a point close to the bottom of the hollowing of the adaptor, the section of said base hollow increasing in the direction of the opening of the adaptor until defining a maximum gap corresponding with the maximum height of the lower base hollowing, and the upper and lower surfaces of the hollow upper appendage progressively separate from one another from a point close to the bottom of the hollow of the adaptor, the section of said hollow appendage increasing in the direction of the opening of the adaptor until determining a maximum gap defining a maximum height of the hollow appendage, such that the union of the maximum heights of the lower base hollow and of the hollow appendage determine a line of maximum height of the opening of the housing of the adaptor, such that from said line of maximum height the upper surface of the hollow appendage and the lower surface of the lower base hollow begin to converge in the direction opposite to that of the bottom of the hollowing until the union of both surfaces form a union line located on the opposite side of the bottom of the hollow and in front of the line of maximum height of the opening of the hollowing of the adaptor;

and a retaining system securing the fastening of the tooth in the adaptor.

21. A tooth configured to be connected to an adaptor, comprising:

a front wear part configured to contact dirt and stones;

a rear coupling part in the form of a projection or nose;

the rear coupling part comprising:

a lower base body comprising an upper surface and a lower surface;

an upper appendage arranged on the lower base body, the upper appendage comprising an upper surface and a lower surface forming an upper base and lower base of a quadrilateral section, respectively;

a free end opposite to the front wear part; and an end opposite to the free end and attached to the front wear part;

the upper and lower surfaces of the lower base body progressively separate from one another from a point close to or at the free end of the nose, the section of lower base body increasing in the direction of the front wear part of the tooth until defining a maximum separation between the upper and lower surfaces of the lower base body;

the upper and lower surfaces of the upper appendage progressively separate from one another from a point close to or at the free end of the nose, the section of said upper appendage increasing in the direction of the tip of the tooth until defining a maximum separation between the upper and lower surfaces of the upper appendage;

the union of the maximum separation of the lower base body and the maximum separation of the upper appendage join to define a line of maximum height of the nose of the tooth, such that after the line of maximum height of the nose of the tooth in a direction toward the front wear part, the upper surface of the upper appendage and the lower surface of the lower base body begin to converge towards the tip of the tooth.

22. The tooth according to claim 21, wherein the quadrilateral section is trapezoidal.

23. The tooth according to claim 21, wherein the quadrilateral section extends up to a beginning of the front wear part.

24. The tooth according to claim 21, wherein the upper surface and the lower surface of the upper appendage form an upper base and lower base of the quadrilateral section, respectively, the upper base and the lower base narrower than the upper surface of the lower base body along an entire length of the upper appendage where the appendage overlays the lower base body.

25. The tooth according to claim 21, wherein the upper appendage is centered with respect to the upper surface of the lower base body.

26. The tooth according to claim 21, wherein the tooth is a dredging tooth.

* * * * *